US007171890B2

(12) United States Patent
Oudelaar

(10) Patent No.: US 7,171,890 B2
(45) Date of Patent: Feb. 6, 2007

(54) TELESCOPIC LIFTING DEVICE

(75) Inventor: Tone Oudelaar, Beuningen (NL)

(73) Assignee: Actuant Corporation, Glendale, WI (US)

( * ) Notice: Subject to any disclaimer, the term of this patent is extended or adjusted under 35 U.S.C. 154(b) by 29 days.

(21) Appl. No.: 11/018,576

(22) Filed: Dec. 21, 2004

(65) Prior Publication Data

US 2005/0161648 A1 Jul. 28, 2005

(30) Foreign Application Priority Data

Dec. 23, 2003 (NL) ..... 1025120

(51) Int. Cl.
*F01B 7/20* (2006.01)

(52) U.S. Cl. ..... 92/51; 92/52; 91/168

(58) Field of Classification Search ..... 92/51, 92/52, 53; 91/167 R, 168
See application file for complete search history.

(56) References Cited

U.S. PATENT DOCUMENTS 2,212,329 A * 8/1940 Smith, Jr. ..... 173/34
2,649,693 A * 8/1953 Venus ..... 91/167 R
3,250,182 A * 5/1966 Nansel ..... 91/167 R
4,733,598 A * 3/1988 Innes et al. ..... 91/168
5,263,402 A * 11/1993 Gottlieb ..... 92/53
5,377,432 A * 1/1995 Kishi ..... 37/186
2002/0144349 A1 10/2002 Blyshak et al.

FOREIGN PATENT DOCUMENTS

EP 0 567 218 10/1993
EP 0 897 894 2/1999

* cited by examiner

*Primary Examiner*—Hoang Nguyen
(74) *Attorney, Agent, or Firm*—Quarles & Brady LLP

(57) ABSTRACT

The invention relates to a telescopic lifting column. The lifting column comprises a plurality of tube bodies which are arranged concentrically inside one another and are axially movable in each case with respect to each other. Furthermore, the lifting column comprises a hydraulic actuator unit which is arranged in the tube bodies so as to be operating in the axial direction. The hydraulic actuator unit comprises a first hydraulic cylinder-piston unit and a second hydraulic cylinder-piston unit connected with the first, the first cylinder-piston unit being connected to a first end of the telescopic lifting column and the second cylinder-piston unit being connected to a second end of the telescopic lifting column. The first cylinder-piston unit is of the type having a first variable operating chamber and a second variable operating chamber. The second cylinder-piston unit is of the type having a single variable operating chamber which is in communication with the second operating chamber of the first cylinder-piston unit.

14 Claims, 1 Drawing Sheet

TELESCOPIC LIFTING DEVICE

Figure 3:
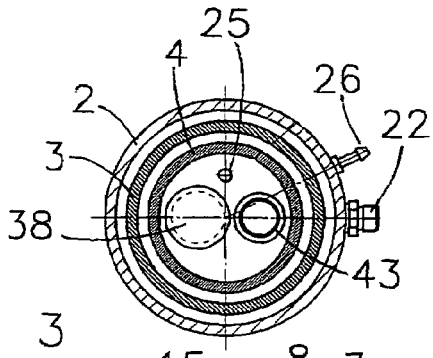

The invention relates to a telescopic lifting column, comprising a plurality of tube bodies which are arranged concentrically inside one another and are axially movable in each case with respect to each other, and a hydraulic actuator unit which is arranged in the tube bodies so as to be operating in the axial direction. This actuator unit comprises a first hydraulic cylinder-piston unit and a second hydraulic cylinder-piston unit connected with the first, the first cylinder-piston unit being connected to a first end of the telescopic lifting column and the second cylinder-piston unit being connected to a second end of the telescopic lifting column, with the first cylinder-piston unit having a variable operating chamber and the second cylinder-piston unit having a variable operating chamber, said operating chambers being in communication with one another.

A lifting column of this type is known. US 2002/0144349 A1 shows a lifting column for an operating table. The lifting column has four tube bodies which are arranged concentrically inside one another and a hydraulic actuator unit. The actuator unit has two cylinder-piston units of the type where each has a first and a second variable operating chamber. The first cylinder-piston unit is connected to a base by means of a piston rod. The second cylinder-piston unit is connected to the table top by means of a piston rod. The first operating chamber of the first cylinder-piston unit is connectable to a pump or to a reservoir via a control valve. The first operating chambers of the first and second cylinder-piston units are connected to one another via a hydraulic line, so that the first operating chambers are simultaneously in communication with the pump or the reservoir. The second operating chamber of the second cylinder-piston unit is connectable to the pump and the reservoir via a valve. The second operating chambers of the first and second cylinder-piston units are likewise connected to one another via a hydraulic line, so that the second operating chambers are likewise simultaneously in communication with the pump or the reservoir. When the volume of the first operating chambers increases, the distance of the table top to the floor surface increases.

A consequence of the design of the cylinder-piston units of the known lifting column is that both the first and the second operating chambers have to be connectable to the pump and the reservoir and therefore at least one connection port and one supply/discharge line for hydraulic fluid have to be provided for each cylinder-piston unit. Furthermore, at least two control valves are required in order to be able to connect the operating chambers to the pump or to the reservoir.

It is an object of the invention to provide an improved lifting column of simplified design.

This object is achieved by a lifting column according to the preamble of claim 1, characterized in that the first cylinder-piston unit is of the type having a first variable operating chamber and a second variable operating chamber, and the second cylinder-piston unit is of the type having a single variable operating chamber which is in communication with the second operating chamber of the first cylinder-piston unit.

According to the invention, the operating chamber of the second cylinder-piston unit and the second operating chamber of the first cylinder-piston unit together therefore form a substantially closed space. When the first operating chamber of the first cylinder-piston unit increases in volume, a decrease in volume of the second operating chamber of the first cylinder-piston unit takes place and, as a result of the connection, an increase in volume of the operating chamber of the second cylinder-piston unit takes place. Only one external connection is required to push the pistons of the respective cylinder-piston units out or to pull them in in order to supply hydraulic fluid from a pump or to discharge it to a reservoir. As a result, in principle only one control valve or valve assembly is required to be able to connect to first operating chamber of the first cylinder-piston unit to the pump or to the reservoir. Furthermore, compared to the known design according to US 2002/0144349, the lifting column according to the invention requires less hydraulic fluid to achieve the same outward stroke because, in the known design, fluid from the operating chamber of which the volume is decreased during pushing out, is discharged to a reservoir without being utilized.

Another aspect of the invention relates to a lifting column according to the preamble of claim 14, in which the lifting column comprises three tube bodies, the hydraulic actuator unit being connected to the middle tube body.

As a result of this design of the lifting column, the outermost tube sections are extended or retracted synchronously over an equal distance with respect to the middle tube section when the actuator unit is being operated. This results in a more stable lifting column capable of assuming any position between the completely extended state and the completely retracted state.

Figure 1:
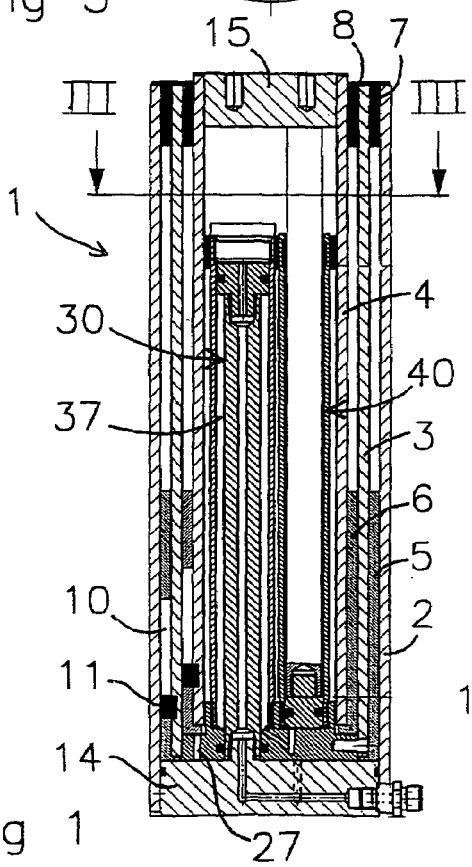
Figure 2:
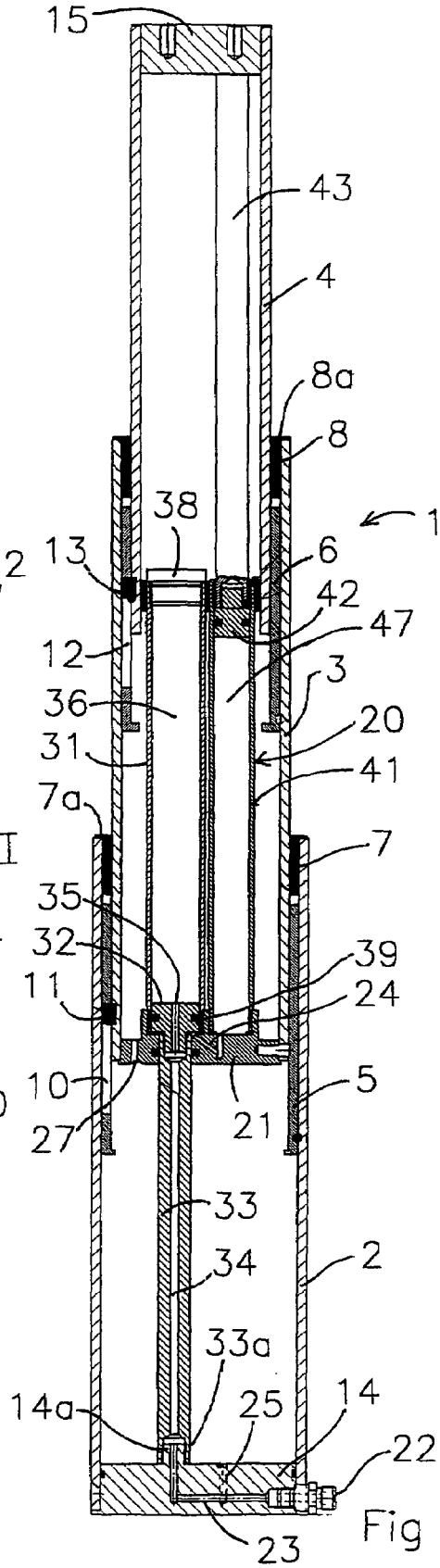

The invention will be explained in more detail using a preferred embodiment and with reference to the drawing, in which:

FIG. 1 shows a longitudinal cross section of a preferred embodiment of a lifting column according to the invention in the completely retracted state, FIG. 2 shows a longitudinal cross section of the lifting column of FIG. 1 in the completely extended state, and FIG. 3 shows a cross section of the lifting column on line III—III of FIG. 1.

FIGS. 1 and 2 show a telescopic lifting column 1 according to the invention in the completely retracted and the completely extended states. The preferred embodiment shown is designed to be used in an upright position. In this preferred embodiment, the lifting column 1 has a bottom tube section 2, a middle tube section 3 and a top tube section 4. The middle tube section 3 has a smaller outer diameter than the internal diameter of the bottom tube section 2. The top tube section 4 has a smaller outer diameter than the inner diameter of the middle tube section 3. In the completely retracted state (FIG. 1), the tube sections 2, 3, 4 are arranged concentrically inside one another.

A substantially sleeve-shaped sliding bearing 5, which is slideable with respect to the two tube sections 2 and 3, is arranged between the tube sections 2 and 3. A substantially sleeve-shaped sliding bearing 6, which is slideable with respect to the two tube sections 3 and 4, is arranged between the tube sections 3 and 4. The sliding bearings 5 and 6 are provided on their underside with a radially inward flange 5*a* and 6*a*, respectively. A groove 10 is provided in the sliding bearing 5, which groove 10 extends in the axial direction. A projection 11 is arranged on the outer surface of the middle tube section 3, near the bottom thereof, which projection 11 is accommodated in the groove 10. In an identical manner, a groove 12 is provided in the sliding bearing 6, which groove 12 extends in the axial direction, and a projection 13 is arranged near the bottom of the top tube section 4, which projection 13 is accommodated in the groove 12.

A sealing cap 7 is arranged at the top end of the bottom tube section 2 and with the outside bears against the inner surface of the bottom tube section 2 and with the inside bears against the outer surface of the middle tube section 3. The sealing cap 7 has a flange 7*a* which bears against the end side of the bottom tube section 2. The sealing cap 7 serves as a spacer between the bottom tube section 2 and the middle tube section 3. Near the top end of the middle tube section 3, a sealing cap 8 having a flange 8*a* is arranged in an identical manner between the middle tube section 3 and the top tube section 4 and serves as a spacer between the middle tube section 3 and the top tube section 4.

The bottom tube section 2 is provided with a base plate 14 which serves as a sealing cover for the underside of the bottom tube section 2. The top tube section 4 is provided with a cover plate 15 at the top.

The lifting column 1 comprises a hydraulic actuator unit 20 which is arranged in the interior space delimited by the tube sections 2, 3, 4. The actuator unit 20 comprises a first cylinder-piston unit 30 having a cylinder 31 with a cylinder head 38 and extending in the axial direction of the tube sections 2–4, and a piston 32 arranged in the cylinder 31 and having a piston rod 33. A cylinder 41 of a second cylinder-piston unit 40 is arranged substantially parallel with and next to the cylinder 31 of the first cylinder-piston unit 30. The second cylinder-piston unit 40 has a piston 42 with a piston rod 43. The cylinders 31 and 41 are arranged in an upright position and next to one another on a base plate 21 and are fixedly attached to the latter, said base plate 21 in turn being fixedly mounted on the underside of the middle tube section 3.

The piston rod 33 of the first cylinder-piston unit 30 extends through an aperture in the base plate 21 downwards and is connected by a bottom end 33*a* to a nipple 14*a* which is fitted on the base plate 14 of the bottom tube section 2, for example by means of a threaded connection. The piston rod 34 preferably extends at right angles to the bottom. The piston rod 43 of the second cylinder-piston unit 40 is connected to the cover plate 15 of the top tube section 4.

The piston rod 33 and the piston 32 are provided with a supply/discharge duct 34, 35 for hydraulic fluid. A connection port 22 is arranged in the base plate 14, to which port a hydraulic line can be connected which joins the lifting column to a hydraulic assembly (not shown) comprising a pump, a reservoir and at least one control valve. A duct 23 is formed in the base plate 14, between the connection port 22 and the nipple 14*a*, connecting the connection port to the supply/discharge duct 34 in the piston rod 33.

Hydraulic fluid can be supplied to and/or discharged from a first operating chamber 36 in the cylinder 31 via the supply/discharge duct 34, 35 in the piston 32 and piston rod 33, which first operating chamber 36 is delimited by the cylinder wall, the cylinder head 38 and the piston 32. The first cylinder-piston unit 30 has a second operating chamber 37 which is delimited by the cylinder wall, the piston 32, the piston rod 34 and the base plate 21 which is connected to the middle tube section. In FIG. 1, the second operating chamber 37 is at a maximum volume and the first operating chamber 36 at a minimum volume. In FIG. 2, the first operating chamber is at a maximum volume and the second operating chamber 37 at a minimum volume.

The second cylinder-piston unit 40 is of the type which has only one operating chamber 47. The operating chamber 47 of the second cylinder-piston unit 40 is connected to the second operating chamber 37 of the first cylinder-piston unit 30 via a duct 24 which is arranged in the base plate 21. The operating chamber 47 of the second cylinder-piston unit 40 and the second operating chamber 37 of the first cylinder-piston unit 30 in principle form a closed entity and together have a constant volume. Preferably, the first cylinder-piston unit 30 and the second cylinder-piston unit 40 have an identical stroke length and the maximum volume of the operating chamber 47 (see FIG. 2) is equal to the maximum volume of the second operating chamber 37 (see FIG. 1). This is achieved by the second cylinder 41 having an inner diameter which corresponds to the difference between the inner diameter of the first cylinder 31 and the outer diameter of the piston rod 34. This means that it is possible to push the cylinder-piston units 30, 40 out at a constant and uniform speed, independently of the load.

In a practical embodiment, the total length of the lifting column in the completely retracted state (FIG. 1) could be approximately 35 cm, for example, and in the completely extended state (FIG. 2) approximately 75 cm. In that case, the first and second cylinder-piston units 30, 40 each have a length of stroke of 20 cm.

A bypass 39 is provided at the bottom end of the cylinder 31 of the first cylinder-piston unit 30, by which hydraulic fluid can flow along the piston 32 of the first operating chamber 36 to the second operating chamber 37 when the piston is near the end of the stroke, as is indicated in FIG. 2. In this embodiment, the bypass 39, by way of example, is in the shape of a small recess on the inside of the cylinder wall, but may, for example, also be designed as a duct. The purpose of the bypass 39 is to prevent the second operating chamber not being filled to its maximum volume as a result of hydraulic oil leaking out of the second operating chamber 37 and the operating chamber 47 if the gasket is not completely sealed. Any shortfall in oil is supplemented via the bypass 39 and the telescopic lifting column 1 can thus still reach its maximum extended state despite the losses due to leakage.

A discharge duct 27 is arranged in the base plate 21 and serves for discharging hydraulic fluid which has leaked from the hydraulic actuator unit 20 onto the base plate 21 down towards the bottom tube section. A discharge duct 25 is arranged in the base plate 14 and is connected to a discharge port 26 in order to discharge hydraulic fluid which has leaked onto the base plate 14 to a reservoir.

In use, with the lifting column in the completely retracted state (FIG. 1), hydraulic fluid is supplied under pressure via connection port 22 and supply/discharge ducts 23, 34 and 35 to the first operating chamber 36. As a result, the first operating chamber 36 increases in volume and the cylinder 31 is pushed upwards with respect to the piston 32 while carrying the base plate 21 along. At the same time, the volume of the second operating chamber 37 decreases and hydraulic fluid is pumped from the second operating chamber 37 to the operating chamber 47 of the second cylinder-piston unit via the duct 24, as a result of which the operating chamber 47 increases in volume and the piston 42 inside the cylinder 41 is pushed upwards, by which the top tube section 4 which is connected to the piston rod 43 is moved upwards with respect to the cylinder 41.

In the completely retracted state of FIG. 1, the projection 11 is positioned against a bottom edge of the groove 10 in the sliding bearing 5. The projection 13 is likewise positioned against a bottom edge of the groove 12 in the sliding bearing 6. When the top tube section moves upwards, the projection 13 will be guided upwards through the groove 12 until it hits the top edge of the groove 12, after which the sliding bearing 6 will be moved upwards by the projection 13 with respect to the middle tube section 3. The projection 11 on the middle tube body 3 will be guided upwards through the groove 10 in a similar way until it hits the top edge of the groove 10, after which the sliding bearing 5 will be moved upwards by the middle tube body 3 and displaced upwards with respect to the bottom tube body 2.

When the lifting column 1 is in the completely extended state according to FIG. 2, the first operating chamber 36 can be connected to a reservoir via the connection port 22 and the ducts 35, 34 and 23. This leads to a loss of pressure in the first operating chamber 36, causing the lifting column 1 to be pushed into one another by the effect of the load which is acting on them. In the process, hydraulic fluid flows from the operating chamber 47 of the second cylinder-piston unit 40 to the second operating chamber of the first cylinder-piston unit 30 via the duct 24. Furthermore, hydraulic fluid flows from the first operating chamber 36 to the reservoir. The projections 13 and 11, respectively, are guided downwards in the associated grooves 12 and 10, respectively, until they reach the bottom edge of the grooves 12 and 10, respectively, after which the sliding bearings 6 and 5, respectively, are pulled along downwards by the tube sections 4 and 3, respectively. The sliding bearings 5, 6 which slide along concomitantly have a positive effect on the rigidity of the lifting column 1.

The invention claimed is:

1. Telescopic lifting column, comprising:

a plurality of tube bodies which are arranged concentrically inside one another and are axially movable in each case with respect to each other, a hydraulic actuator unit which is arranged in the tube bodies so as to be operating in the axial direction, comprising a first hydraulic cylinder-piston unit and a second hydraulic cylinder-piston unit connected with the first, the first cylinder-piston unit being connected to a first end of the telescopic lifting column and the second cylinder-piston unit being connected to a second end of the telescopic lifting column, in which the first cylinder-piston unit has a variable operating chamber and the second cylinder-piston unit has a variable operating chamber, said operating chambers being interconnected, characterized in that the first cylinder-piston unit is of the type having a first variable operating chamber and a second variable operating chamber, and the second cylinder-piston unit is of the type having a single variable operating chamber which is in communication with the second operating chamber of the first cylinder-piston unit.

2. Telescopic lifting column according to claim 1, in which a bypass is arranged in the first cylinder-piston unit, in the region of the end of the piston stroke, where the volume of the second operating chamber is minimal, which bypass connects the first and second operating chambers of the first cylinder-piston unit with one another.

3. Telescopic lifting column according to claim 1 or 2, in which the piston rod and the piston of the first cylinder-piston unit are provided with a supply duct for supplying hydraulic fluid to the first operating chamber.

4. Telescopic lifting column according to claim 3, in which the first end of the telescopic column is provided with a first cover plate on which the piston rod of the first cylinder-piston unit is mounted substantially at right angles thereto.

5. Telescopic lifting column according to claim 4, in which the first cover plate is provided with a connection port and a fluid duct connected thereto, the latter being connected to the supply duct in the piston rod.

6. Telescopic lifting column according to claim 4, in which the second end of the telescopic column is provided with a second cover plate on which the piston rod of the second cylinder-piston unit is mounted substantially at right angles thereto.

7. Telescopic column according to claim 1, in which the first cylinder-piston unit and the second cylinder-piston unit have an identical stroke length and the maximum volume of the operating chamber of the second cylinder-piston unit is equal to the maximum volume of the second operating chamber of the first cylinder-piston unit.

8. Telescopic column according to claim 1, in which the first end of the lifting column is designed to be placed on a base.

9. Telescopic lifting column according to claim 1, in which the lifting column comprises three tube bodies, the hydraulic actuator unit being connected to the middle tube body.

10. Telescopic lifting column according to claim 9, in which the cylinders of the hydraulic actuator unit are fixedly connected to the middle tube body.

11. Telescopic lifting column according to claim 8 in which the lifting column comprises three tube bodies, the hydraulic actuator unit being connected to the middle tube body, and in which the middle tube body has a base plate on which the first and second cylinders rest.

12. Telescopic lifting column according to claim 11, in which the base plate of the middle tube body is provided with a return duct for discharging the hydraulic fluid which has leaked from the actuator unit to the bottom tube body.

13. Telescopic lifting column according to claim 12, in which the first cover plate is provided with a return duct for discharging hydraulic fluid which has leaked from the actuator unit, from the bottom tube body to a reservoir.

14. Telescopic lifting column, comprising:

three tube bodies which are arranged concentrically inside one another and are axially movable in each case with respect to each other, a hydraulic actuator unit which is arranged in the tube bodies so as to be operating in the axial direction, wherein the hydraulic actuator unit is connected to the middle tube body and comprising a first hydraulic cylinder-piston unit and a second hydraulic cylinder-piston unit connected with the first, the first cylinder-piston unit being connected to a first end of the telescopic lifting column and the second cylinder-piston unit being connected to a second end of the telescopic lifting column, in which the first cylinder-piston unit has a first variable operating chamber connected to a connection port for a hydraulic assembly, and a second variable operating chamber, and the second cylinder-piston unit has a variable operating chamber, said second variable operating chamber of the first cylinder-piston unit being interconnected with said operating chamber of the second cylinder-piston unit, wherein said second variable operating chamber of the first cylinder-piston unit and said operating chamber of the second cylinder-piston unit form a closed entity with a constant volume.

* * * * *